US009624611B2

(12) United States Patent
Nakajima et al.

(10) Patent No.: US 9,624,611 B2
(45) Date of Patent: Apr. 18, 2017

(54) SEWING MACHINE

(71) Applicant: JANOME SEWING MACHINE CO., LTD., Hachioji-shi, Tokyo (JP)

(72) Inventors: Makoto Nakajima, Sagamihara (JP); Mikio Koike, Ome (JP); Jun Mafune, Kokubunji (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 14/817,824

(22) Filed: Aug. 4, 2015

(65) Prior Publication Data

US 2016/0237604 A1 Aug. 18, 2016

(30) Foreign Application Priority Data

Feb. 18, 2015 (JP) ..... 2015-029656

(51) Int. Cl.
*D05B 47/04* (2006.01)
*D05B 19/12* (2006.01)
*D05B 63/00* (2006.01)

(52) U.S. Cl.
CPC ..... *D05B 47/04* (2013.01); *D05B 19/12* (2013.01); *D05B 63/00* (2013.01)

(58) Field of Classification Search
CPC ..... D05B 9/12; D05B 47/04; D05B 57/00; D05B 57/02; D05B 57/04; D05B 57/10–57/14; D05B 57/143; D05B 57/30; D05B 63/00; D05B 63/02; D05B 63/04
See application file for complete search history.

(56) References Cited

U.S. PATENT DOCUMENTS 4,215,639 A * 8/1980 Johnson ..... D05B 57/143 112/242
4,331,090 A * 5/1982 Hanyu ..... D05B 63/00 112/229
4,458,613 A * 7/1984 Eguchi ..... D05B 63/00 112/184
4,938,158 A * 7/1990 Hanyu ..... D05B 63/00 112/184
5,660,129 A * 8/1997 Murata ..... D05B 69/12 112/220
5,680,827 A * 10/1997 Sakanobe ..... D05B 63/00 112/255
5,765,493 A * 6/1998 Akahane ..... D05B 57/30 112/167
2008/0229990 A1* 9/2008 Ishikawa ..... D05B 3/02 112/462

FOREIGN PATENT DOCUMENTS

JP 62-2998 A 1/1987

* cited by examiner

*Primary Examiner* — Ismael Izaguirre
(74) *Attorney, Agent, or Firm* — Nath Goldberg & Meyer; Jerald L. Meyer

(57) ABSTRACT

A sewing machine includes a sewing-machine motor that drives, through an upper shaft and a lower shaft, a thread take-up lever, a needle bar, and a shuttle in conjunction one another. In addition, the sewing machine includes a stepping motor different from the sewing-machine motor. A bobbin-thread supply member is driven by drive power from the stepping motor, and applies tension to a bobbin thread in accordance with the drive timing of the stepping motor and the drive amount of the stepping motor. The drive timing of the stepping motor is variable in accordance with a sewing condition.

10 Claims, 11 Drawing Sheets

SEWING MACHINE

CROSS-REFERENCE TO RELATED APPLICATION

This application is based upon and claims the benefit of priority from Japan Patent Application No. 2015-029656, filed on Feb. 18, 2015, the entire contents of which are incorporated herein by reference.

FIELD OF THE INVENTION

The present invention relates to a sewing machine that can adjust a stitch balancing thread tension.

BACKGROUND

In sewing machines, a needle thread is inserted in a needle while being guided by a thread take-up lever, and a bobbin thread is held in a hook. The needle, the hook, and the thread take-up lever are linked one another by an upper shaft that drives a needle bar, a lower shaft that drives the hook, and a toothed belt engaged with the upper and lower shafts. That is, when the upper shaft is driven by drive power, etc., from a motor, the lower shaft also rotates, and the needle and the hook and the thread take-up lever are actuated relative to one another. Sewing machines catch, through the tip of the hook, a thread loop formed by the needle thread when the needle rises after falling to the needle bottom dead center, and form a stitch by intertwining the needle thread and the bobbin thread with each other.

In order to form an appropriate stitch by the needle and bobbin threads, it is necessary to adjust a stitch balancing thread tension appropriately in accordance with a sewing condition. When the tension of the needle thread is excessive in the tension balancing between the needle thread and the bobbin thread, the intertwining point of the needle thread and the bobbin thread is exposed on the front surface of cloth. Conversely, when the tension of the bobbin thread is excessive, the intertwining point of the bobbin thread and the needle thread is exposed on the back surface of the cloth. No intertwining point is formed inside the cloth. In addition, a cloth shrinkage may be caused, or a formed stitch may be weak. The tension of the needle thread and that of the bobbin thread depend on, for example, the supply amount of the needle thread and that of the bobbin thread.

The supply amount of the needle thread is controlled through the reel-out of the needle thread, tension easing of the needle thread, and draw-up of the needle thread by the thread take-up lever, and an automatic stitch balancing thread tension adjusting mechanism. The supply amount of the bobbin thread is adjusted by producing tentative tension to the bobbin thread through an up-and-down action of a bobbin thread supply member that catches the bobbin thread from the lower side (see, for example, JPS62-2998 A). According to this bobbin-thread supply adjusting scheme, the pull-down amount of the bobbin-thread supply member is changed in accordance with a sewing condition, such as a pattern to be sewn, the feeding amount of cloth, a needle amplitude, the kind of cloth, and the kind of thread, thereby changing the supply amount of the bobbin thread in accordance with the sewing condition.

The bobbin-thread supply member shown in JPS62-2998 A is fixed to a shaft, and is swingable around this shaft. Arms fixed to the shaft are each swingably supported by a fork through a pin, the fork is swung around the pin by, a triangle cam which is fixed to a lower shaft and which is rotated by a sewing-machine motor through the lower shaft, a square die swingably supported by a pin near the middle location slides along the groove of an adjuster, and thus the arm swings.

That is, drive power to actuate the bobbin-thread supply member is obtained from the triangle cam fixed to the lower shaft. In this case, a timing at which the bobbin-thread supply member is actuated is limited by the phase of the triangle cam fixed to the lower shaft. Accordingly, the bobbin thread can be reeled out only at a uniform phase for various sewing conditions.

For example, in the case of zigzag stiches, it is necessary to supply a larger amount of bobbin thread than that of straight stitches until the thread take-up lever reaches the top dead center. According to the bobbin-thread supply member shown in JPS62-2998 A, however, since the bobbin thread supply phase is unadjustable, the bobbin thread is not supplied at an appropriate timing, such that the bobbin thread supply phase is advanced in the case of zigzag stitches and the bobbin thread supply phase is retarded in the case of the straight stitch, in accordance with a sewing condition.

SUMMARY OF THE INVENTION

The present invention has been proposed to address the above-explained problems of conventional technologies, and it is an objective of the present invention to provide a sewing machine that can flexibly set the supply timing of a bobbin thread in accordance with a sewing condition.

To accomplish the above objective, a sewing machine according to an aspect of the present invention forms a stitch by intertwining a needle thread and a bobbin thread with each other, and includes: a first motor; an upper shaft rotated by the first motor; a lower shaft linked with the upper shaft, and rotated in conjunction with the upper shaft; a thread take-up lever receiving drive power from the first motor through the upper shaft; a needle bar receiving drive power from the first motor through the upper shaft; a hook receiving drive power from the first motor through the lower shaft; a second motor different from the first motor; and a bobbin-thread supply member driven by drive power from the second motor, applying tension to the bobbin thread and easing the tension in accordance with a drive timing of the second motor and a drive amount of the second motor, in which the bobbin-thread supply member is independently controlled from the thread take-up lever.

The bobbin-thread supply member may supply the bobbin thread by applying the tension to the bobbin thread and by easing the tension.

The bobbin thread supply member may include a lever that pushes down the bobbin thread, and may be pulled up and down by the drive power from the second motor.

The sewing machine may further include: a shaft linked with the bobbin-thread supply member; and a cam pulley restricting a position of the shaft, in which: the second motor may rotate the cam pulley at a predetermined timing and by a predetermined amount; and the shaft may change the position in accordance with a change in restriction by the cam pulley, the change in restriction being caused by the second motor, and may pull up or down the linked bobbin-thread supply member.

The sewing machine may further include a controller detecting a sewing condition, and controlling the bobbin-thread supply member in accordance with the detected sewing condition, in which the bobbin-thread supply member may temporarily apply, in accordance with a predetermined sewing condition, the tension to the bobbin thread before the thread take-up lever reaches a top dead center, and may increase a supply amount of the bobbin thread. In this case, an example predetermined sewing condition is zigzag stitches.

The sewing machine may further include a controller detecting a sewing condition, and controlling the bobbin-thread supply member in accordance with the detected sewing condition, in which the bobbin-thread supply member may draw down, in accordance with a predetermined sewing condition, the bobbin thread at a timing at which the thread take-up lever reaches a top dead center. In this case, an example predetermined sewing condition is straight stitches.

According to the present invention, the bobbin-thread supply member is driven by the second motor different from the first motor that actuates the needle bar, the hook, and the thread take-up lever in conjunction with the operation of the first motor. Accordingly, the drive timing of the bobbin-thread supply member and the drive amount thereof can be flexibly set, and a high-quality stitch can be formed in accordance with various sewing conditions.

BRIEF DESCRIPTION OF THE DRAWINGS

FIG. 1A illustrates an external appearance, while FIG. 1B illustrates a general internal structure;

FIG. 2A illustrates a condition in which the bobbin-thread supply member is located at the top position, while FIG. 2B illustrates a condition in which the bobbin-thread supply member is pulled down;

DETAILED DESCRIPTION OF THE EMBODIMENTS

Whole Structure of Sewing Machine

Figure 1A:
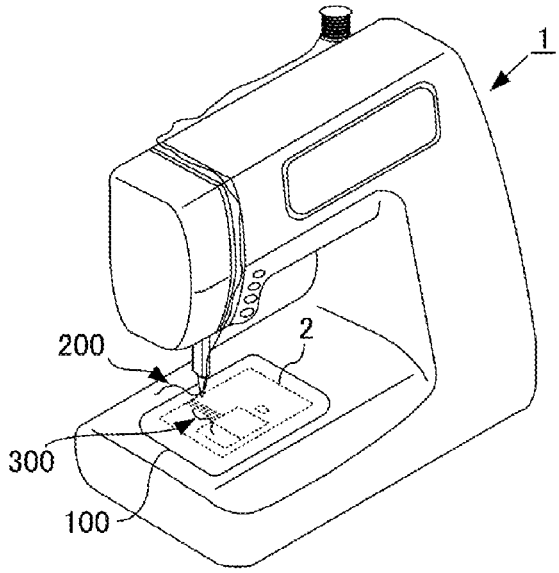
FIGS. 1A and 1B are diagrams illustrating a structure of a whole sewing machine.
Figure 1B:
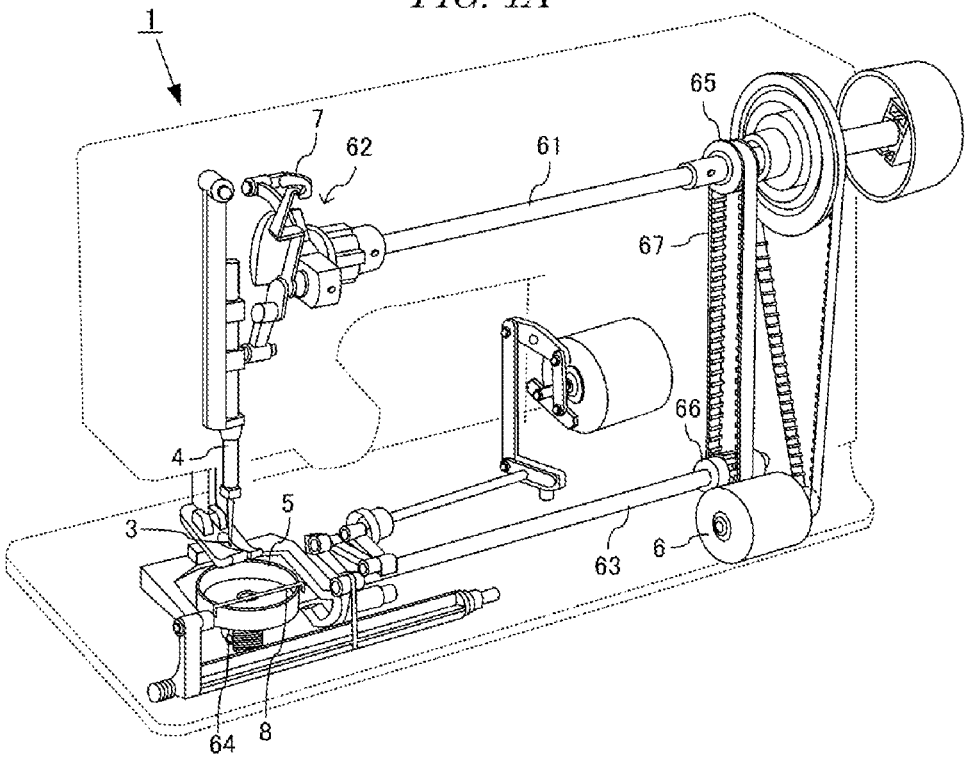

As illustrated in FIGS. 1A and 1B, a sewing machine 1 is a household, professional, or industrial device which moves down a needle 3 to cloth 100 disposed on a needle plate 2, and which forms a stitch by intertwining a needle thread 200 and a bobbin thread 300 with each other, thereby sewing the cloth 100.

This sewing machine 1 includes a needle bar 4 and a shuttle 5. The needle bar 4 extends perpendicularly to the throat plate 2, and is movable up and down in the perpendicular direction. The needle bar 4 supports, at the tip thereof located at the throat-plate-2 side, the needle 3 that is holding the needle thread 200. The shuttle 5 is formed in a hollow drum shape with an opened plane, is attached horizontally or perpendicularly to the throat plate 2, and is rotatable in the circumferential direction. This shuttle 5 holds therein a bobbin around which the bobbin thread 300 is wound.

According to this sewing machine 1, by the up-and-down action of the needle bar 4, the needle 3 passes completely through the cloth 100 together with the needle thread 200, and when the needle 3 rises, a needle thread loop is formed by a friction between the cloth 100 and the needle thread 200. Next, the rotating shuttle 5 catches the needle thread loop, the bobbin which reels out the bobbin thread 300 passes through the needle thread loop together with the rotation of the shuttle 5, thereby the needle thread 200 and the bobbin thread 300 are intertwined with each other and a stitch is formed.

The needle bar 4 and the shuttle 5 are driven through individual transmission mechanisms with a sewing-machine motor 6 being as a common drive source. The needle bar 4 is linked with, through a crank mechanism 62, an upper shaft 61 that extends horizontally. The rotation of the upper shaft 61 is converted into linear motion by the crank mechanism 62, and the linear motion is transmitted to the needle bar 4. Hence, the needle bar 4 moves up and down. The shuttle 5 is linked with, through a gear mechanism 64, a lower shaft 63 that extends horizontally. When the shuttle 5 is installed horizontally, the gear mechanism 64 is, for example, a cylindrical worm gear that has a shaft angle of 90 degrees. The rotation of the lower shaft 63 is converted by 90 degrees by the gear mechanism 64, and the converted drive power is transmitted to the shuttle 5. Hence, the shuttle 5 horizontally rotates.

The upper shaft 61 is provided with a pulley 65 with a predetermined number of teeth. In addition, the lower shaft 63 is provided with a pulley 66 that has the same number of teeth as that of the pulley 65 of the upper shaft 61. Both pulley 65, 66 are linked by a toothed belt 67. When the upper shaft 61 rotates together with the rotation of the sewing-machine motor 6, the lower shaft 63 also rotates through the pulley 65 and the toothed belt 67. Hence, the needle bar 4 and the shuttle 5 are synchronously actuated with each other.

The sewing machine 1 further includes a thread take-up lever 7 and a bobbin-thread supply member 8. The thread take-up lever 7 is a lever that is located in the halfway of the thread path between a thread spool and the needle 3, and is formed with, at the tip of this lever, a hole through which the needle thread 200 passes. The thread take-up lever 7 has the basal end rotatably supported by a horizontal shaft that is in parallel with the upper shaft 61, and has the lever middle part linked with the crank mechanism 62. Hence, the thread take-up lever 7 moves the tip up and down around the horizontal shaft by the rotation of the upper shaft 61. The thread take-up lever 7 changes the length of the thread path by the up-and-down action to reel out the needle thread 200 from the thread spool, supplies the needle thread 200 that has eased tension by the move-down action, and draws up the needle thread 200 by the move-up action to tighten a stitch.

Figure 2A:
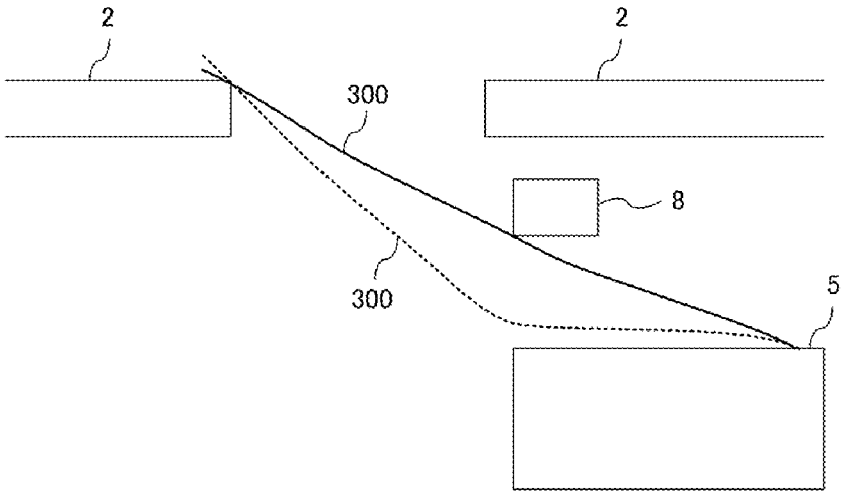
FIGS. 2A and 2B are diagrams illustrating an action of a bobbin-thread supply member.
Figure 2B:
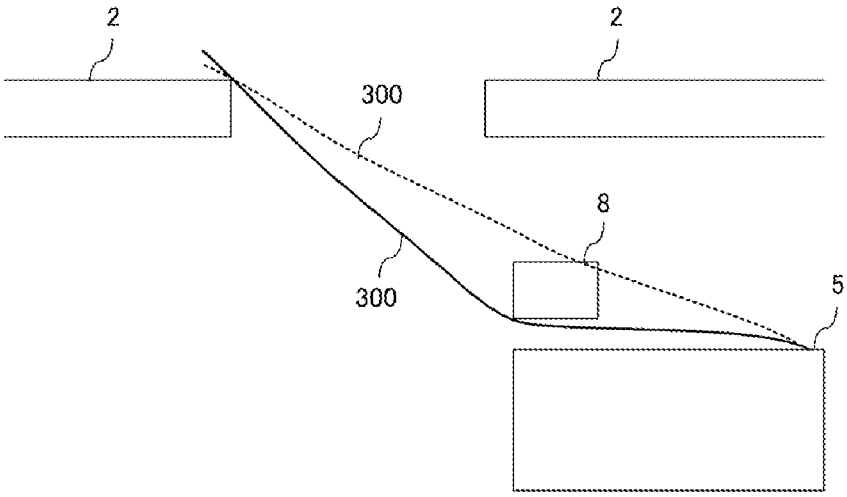

The bobbin-thread supply member 8 reels out the bobbin thread 300 at an optional timing, supplies, to form a stitch, the bobbin thread 300 that has eased tension at an optional timing, and draws up the bobbin thread 300 to tighten a stick at an optional timing by application of tension and easing thereof to the bobbin thread 300 at an optional timing. This bobbin-thread supply member 8 is a lever that traverses the shuttle 5, and extends horizontally above the shuttle 5 that holds therein the bobbin. As illustrated in FIGS. 2A and 2B, the bobbin-thread supply member 8 can change the height of the lever part that extends horizontally. The bobbin thread 300 is directed to the opening of the throat plate 2 disposed above the bobbin-thread supply member 8 while being caught by the bobbin-thread supply member 8 from the lower side thereof.

Hence, when the bobbin-thread supply member 8 is pulled down, the bobbin thread 300 is drawn down from the stitch side (see FIG. 2B). In addition, when the bobbin-thread supply member 8 is pulled down, the bobbin thread 300 is pushed down. Hence, the thread path length of the bobbin thread 300 bent by the bobbin-thread supply member 8 (see FIG. 2B) becomes long in comparison with the thread path length of the bobbin thread 300 linearly directed to the throat plate 5 from the shuttle 5 (see FIG. 2A), and thus the bobbin thread 300 is reeled out by this difference in thread path length. In addition, when the bobbin-thread supply member 8 is pulled up and returns to the original position, the reeled-out bobbin thread 300 has eased tension, and the bobbin thread 300 in accordance with the difference in thread path length is supplied to form a stitch.

(Structure of Bobbin-Thread Supply Member)

Figure 3:
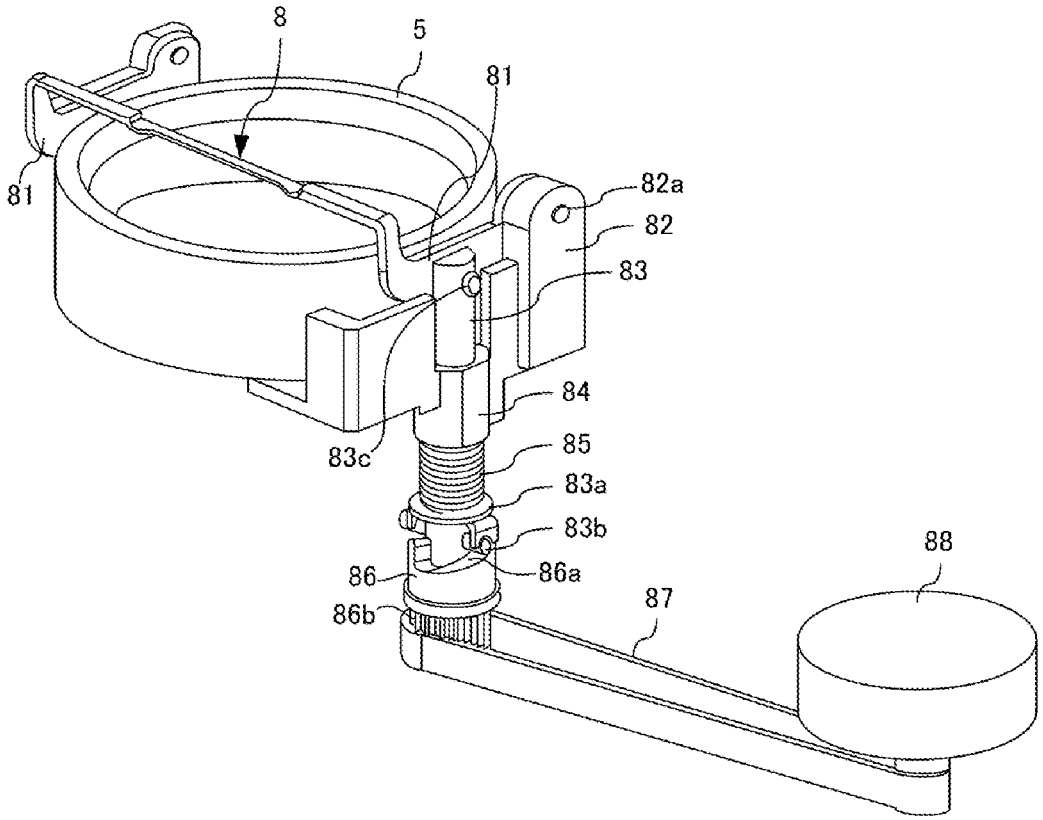
FIG. 3 is a diagram illustrating a detailed structure of the bobbin-thread supply member.
Figure 4:
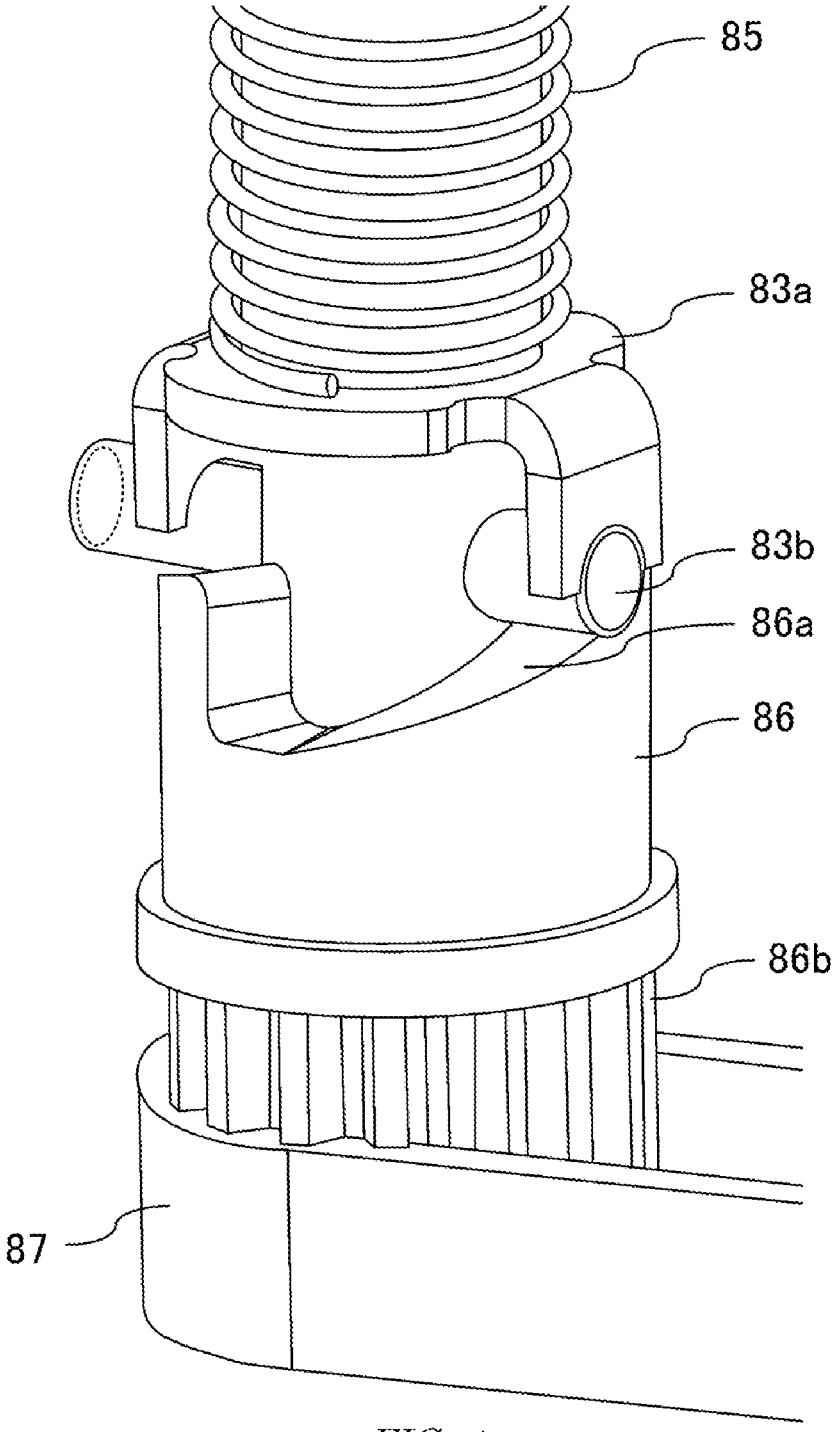
FIG. 4 is a partial enlarged view of the bobbin-thread supply member.

FIG. 3 illustrates a detailed structure of the bobbin-thread supply member 8, and FIG. 4 is a partial enlarged view of the bobbin-thread supply member 8. As illustrated in FIGS. 3 and 4, the bobbin-thread supply member 8 includes arms 81 that extend from both ends of a lever part, and the bobbin-thread supply member 8 is formed in a U-shape as viewed from the top, and is formed in an L-shape as viewed from the side as a whole. That is, the bobbin-thread supply member 8 includes the lever which traverses the shuttle 5 and which is bent downwardly at respective tip end portions of the lever outside the shuttle 5. Respective tip end portions are further bent and extended horizontally.

Each arm 81 of the bobbin-thread supply member 8 is swingably supported by an unmoved support plate 82 via a pin 82*a* that is the pivot (swing) point. A shaft 83 that is a point of force for up-and-down action is linked with the middle portion of the arm 81 via a pin 83*c*. The shaft 83 extends downwardly and perpendicularly from the linked portion with the pin 83*c*, and is fitted in a bearing 84 so as to be movable up and down along the axis. The bobbin-thread supply member 8, the support plate 82, and the shaft 83 satisfy a third-class lever relationship, and the bobbin-thread supply member 8 rotates (swings) around the pins 82*a* of the support plate 82 so as to pull up and down the lever part by the shaft 83 that moves up and down along the axis.

In an up-and-down action mechanism for the shaft 83, the shaft 83 is engaged with a compression spring 85 that is fixed to the lower face of the bearing 84. The lower portion of the shaft 83 is provided with a flange 83*a*, and the one end of the compression spring 85 abuts the shaft 83 with the flange 83*a* being as a seat. Downward force is constantly applied to the shaft 83 by the expansion spring force of the compression spring 85.

However, the shaft 83 has a position restricted by a cam mechanism, and a move-down timing and a descent amount are controlled by the cam mechanism. That is, a pin 83*b* that extends in a direction orthogonal to the axis of the shaft 83 passes completely through the lower portion of the shaft 83, and protrudes from the circumference of the shaft 83. The pin 83*b* abuts, as a cam follower, a cam face 86*a* located right below the pin 83*b*. Hence, the move-down action of the shaft 83 by the compression spring 85 is restricted by the cam face 86*a*.

Figure 5:
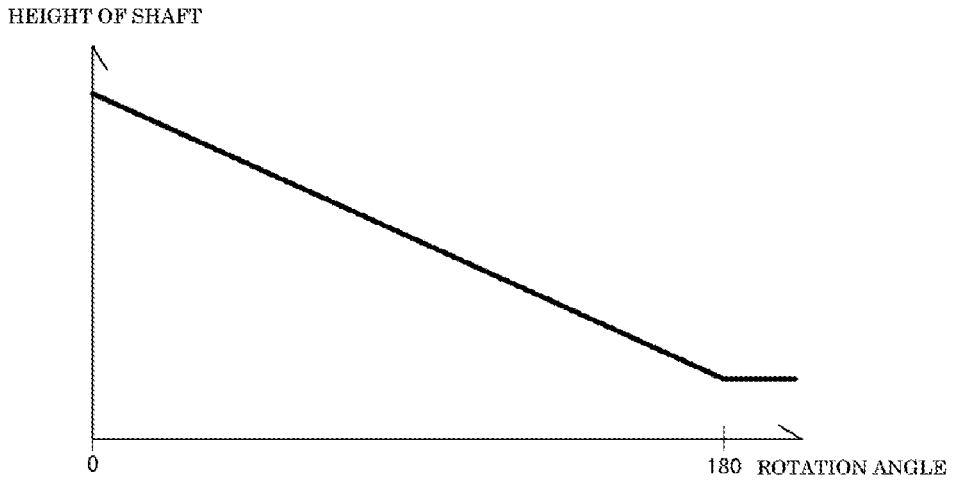
FIG. 5 is a graph illustrating a relationship between a rotation angle of a cam face and a height of a shaft.

FIG. 5 is a graph illustrating a relationship between a rotation angle of the cam face 86*a* and a height of the shaft 83. With the top part being as a 0 degree, the cam face 86*a* has a continuous downward slant to 180 degrees. In other words, with 180 degrees being as the bottom, the cam face 86*a* has a continuous upward slant to 0 degree. That is, the descent amount of the shaft 83 changes in accordance with the position of the cam 86*a* that abuts the pin 83*b*, and thus the pull-down amount of the bobbin-thread supply member 8 is controlled.

Returning to FIG. 3 and FIG. 4 again, the cam face 86*a* is formed at the upper face of a cylindrical cam pulley 86. A pulley part 86*b* that has teeth arranged side by side on the circumference is provided below the cam pulley 86. The teeth are arranged along the circumferential direction of the cam pulley 86. The pulley part 86*b* is engaged with a toothed belt 87. In addition, the sewing machine 1 is provided with a stepping motor 88 different from the sewing-machine motor 6, and the toothed belt 87 links the rotation shaft of the stepping motor 88 with the pulley part 86*b*.

When the stepping motor 88 is driven, the cam face 86*a* rotates through the toothed belt 87 and the pulley part 86*b*. The cam face 86*b* that has the drive pin 83*b* as the cam follower changes the height in accordance with the rotation angle of the cam face 86*a*, and the compression spring 85 pushes down the shaft 83 by what corresponds to this change. When the shaft 83 is pushed down, the bobbin-thread supply member 8 linked with the shaft 83 is also pulled down around the pins 82*a* of the support plate 82. In addition, when the stepping motor 88 is rotated backwards, the shaft 83 is pushed up, and thus the bobbin-thread supply member 8 is also pushed up around the pins 82*a* of the support plate 82.

This mechanism enables the up-and-down action of the bobbin-thread supply member 8 in accordance with the drive timing of the stepping motor 88 and independently from the drive of the sewing-machine motor 6. In addition, the pull-down amount of the bobbin-thread supply member 8 is controlled in accordance with the rotation amount of the stepping motor 88. Still further, during the pull-down action of the bobbin-thread supply member 8, a tentative tension change is produced in the bobbin thread 300, and thus the bobbin thread 300 can be drawn down from a stitch side or reeled out from the bobbin.

(Various Example Control for Bobbin-Thread Supply Member)

Figure 6:
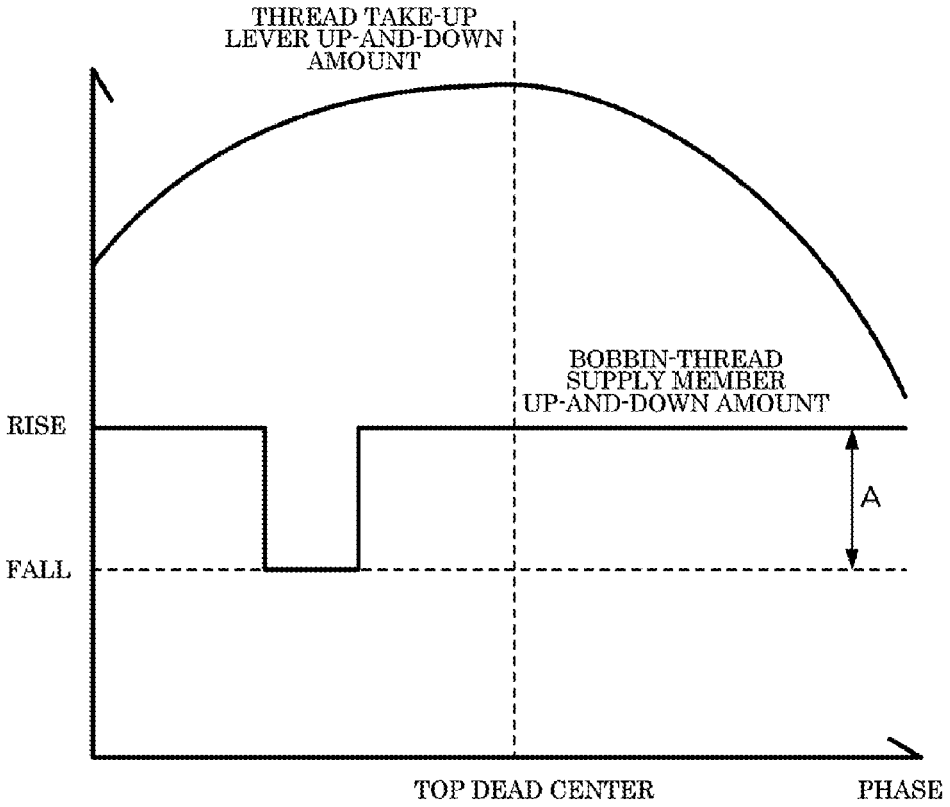
FIG. 6 is a timing chart illustrating a first example control for the bobbin-thread supply member.

Example controls for the bobbin-thread supply member 8 by such a sewing machine 1 will be explained below. In the graph of FIG. 6, the vertical axis represents an up-and-down amount of the thread take-up lever 7 and that of the bobbin-thread supply member 8, while the horizontal axis represents a phase. FIG. 6 illustrates a relationship between the up-and-down amount of the thread take-up lever 7 and that of the bobbin-thread supply member 8.

As illustrated in FIG. 6, as a first example control, the bobbin-thread supply member 8 is pulled down by a pull-down amount A, and is pulled up to return to the top position before the thread take-up lever 7 reaches the top dead center. According to this first example control, in addition to the supply of the bobbin thread 300 by feeding of the cloth 100, the supply amount of the bobbin thread 300 by the up-and-down action of the bobbin-thread supply member 8 can be added before the thread take-up lever 7 reaches the top dead center, and thus the supply amount of the bobbin thread 300 can be increased when the thread take-up lever 7 reaches the top dead center.

When the thread take-up lever 7 reaches the top dead center, the needle thread 200 is drawn up, and thus a stitch is tightened. In the case of zigzag stitches, cloth is likely to shrink due to the tightening of the stitch. According to the first example control, however, since the extra bobbin thread 300 is supplied at the time of the tightening of the stitch, the likelihood of the occurrence of the cloth shrinkage can be reduced.

Figure 7:
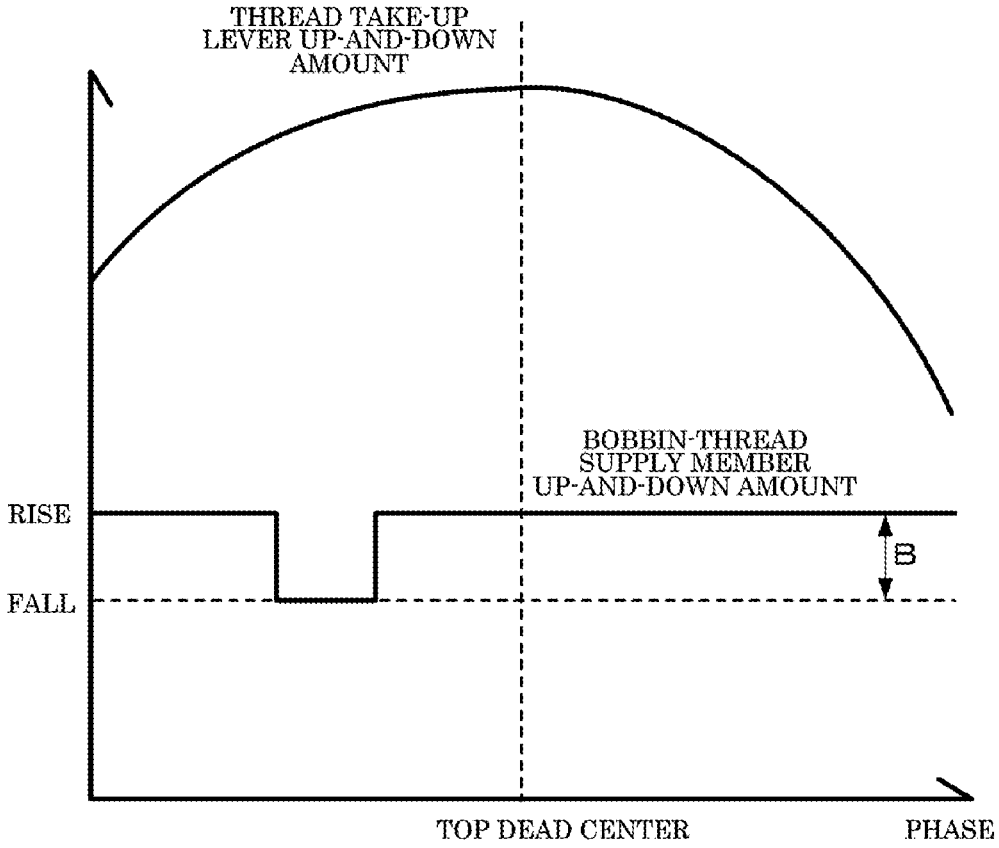
FIG. 7 is a timing chart illustrating a second example control for the bobbin-thread supply member.

As illustrated in FIG. 7, as a second example control, the bobbin-thread supply member 8 is pulled down by a pull-down amount B, and is pulled up to return to the top position before the thread take-up lever 7 reaches the top dead center. Note that the pull-down amount A is not equal to pull-down amount B. According to the second example control, the supply amount of the bobbin thread 300 before the thread take-up lever 7 reaches the top dead center can be adjusted in accordance with the likelihood of the occurrence of cloth shrinkage depending on, for example, the kind of cloth, the thickness of the cloth, and the softness thereof.

Figure 8:
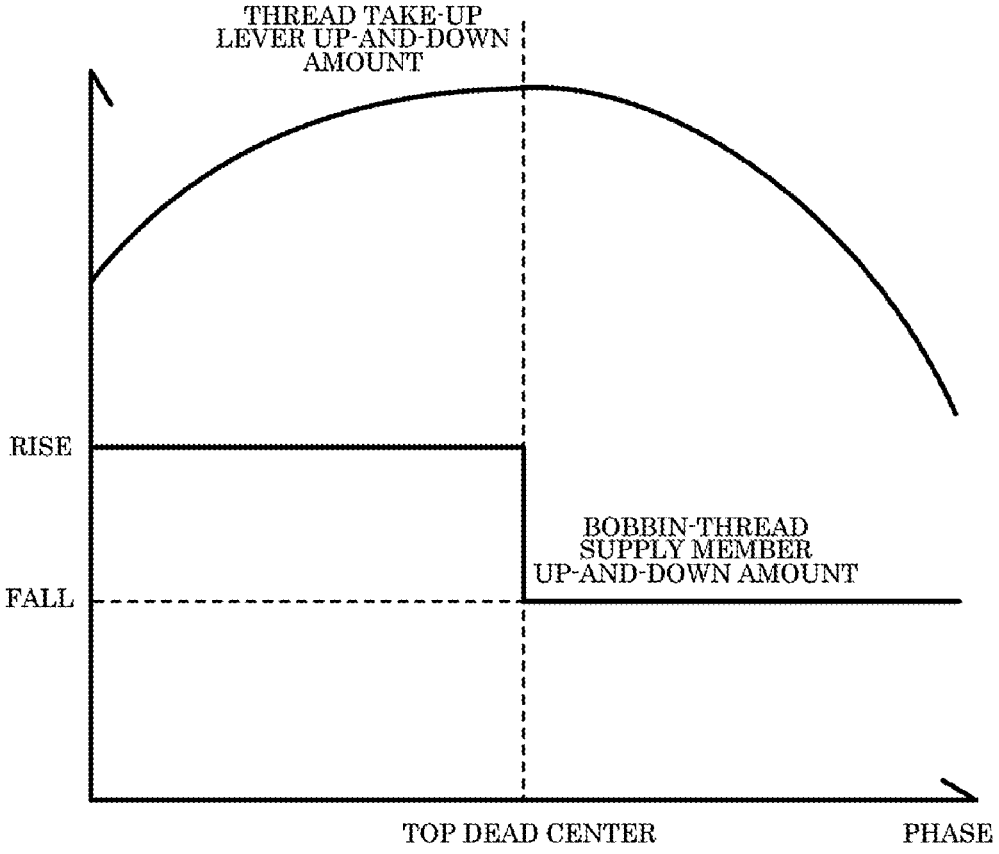
FIG. 8 is a timing chart illustrating a third example control for the bobbin-thread supply member.

As illustrated in FIG. 8, as a third example control, the bobbin-thread supply member 8 is pulled down at a timing when the thread take-up lever 7 reaches the top dead center. That is, simultaneously with the draw-up of the needle thread 200 by the thread take-up lever 7, the bobbin-thread supply member 8 draws down the bobbin thread 300. Since both needle thread 200 and bobbin thread 300 tighten a stitch, a firm stitch can be formed in the case of, for example, straight stitches.

Figure 9:
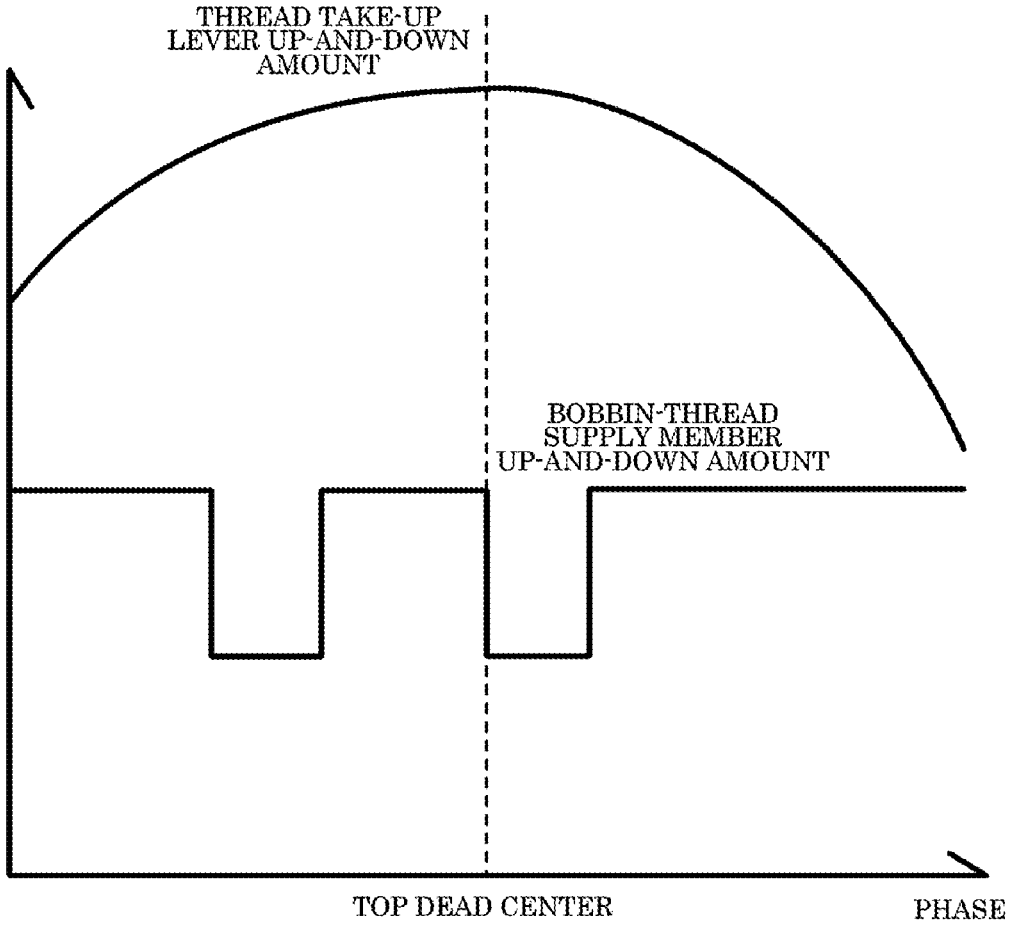
FIG. 9 is a timing chart illustrating a fourth example control for the bobbin-thread supply member.

As illustrated in FIG. 9, as a fourth example control, the bobbin-thread supply member 8 is pulled up and down plural times during a cycle of the up-and-down action of the thread take-up lever 7. The supply amount of the bobbin thread 300 necessary in accordance with each stage of the bobbin-thread consumption caused while a stitch can be provided.

Figure 10:
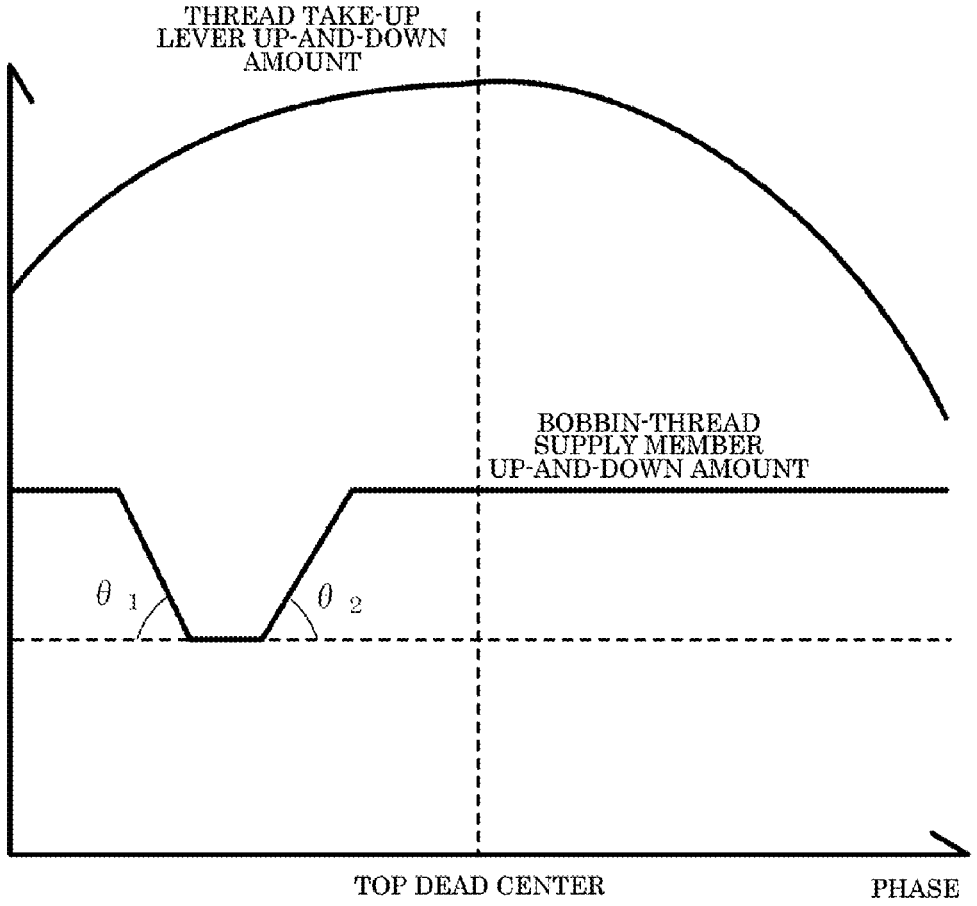
FIG. 10 is a timing chart illustrating a fifth example control for the bobbin-thread supply member.

As illustrated in FIG. 10, as a fifth example control, the bobbin-thread supply member 8 is continuously and gradually pulled down, is continuously and gradually pulled up, or continuously and gradually pulled up and down. For example, a draw-down effect to the bobbin thread 300 caused when the bobbin-thread supply member 8 is pulled down in the short time can be eliminated, and the loosening of the bobbin thread 300 caused when the bobbin-thread supply member 8 is pulled up in the short time can be addressed.

Figure 11:
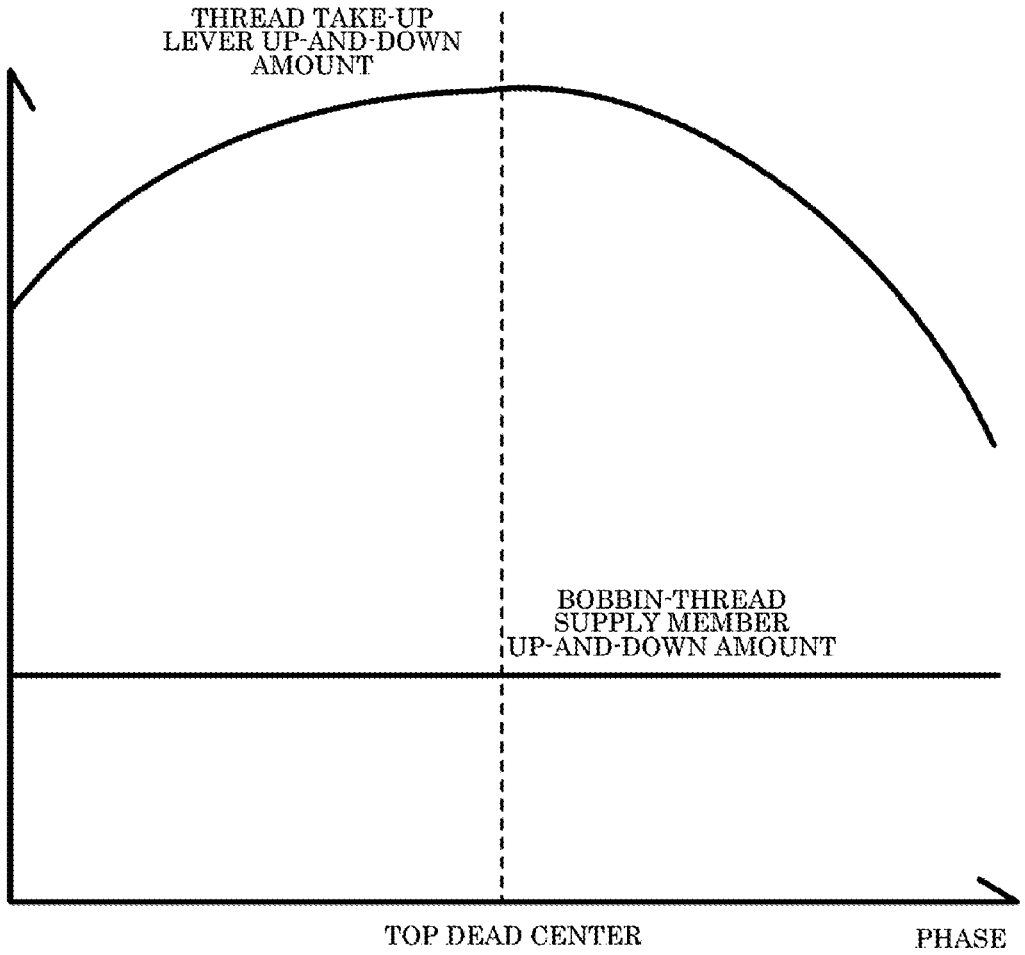
FIG. 11 is a timing chart illustrating a sixth example control for the bobbin-thread supply member.

In addition, as illustrated in FIG. 11, as a sixth example control, the sewing machine 1 can perform a control that does not pull the bobbin-thread supply member 8 up and down.

(Control Structure for Bobbin-Thread Supply Member)

The above-explained various example controls enable the stepping motor 88 to be driven not in conjunction with the sewing-machine motor 6, and can be changed flexibly in accordance with various sewing conditions. Example sewing conditions are the thickness of the cloth 100, the kind of the cloth 100, the feeding speed of the cloth 100, the fiber kind of thread, the thickness of thread, the structure of stitch, such as lock stitch and chain stitch, a sewing pattern, such as straight stitches and zigzag stitches, the kind of sewing, such as reverse stitching and basting, and the kind of the form of stitch.

Figure 12:
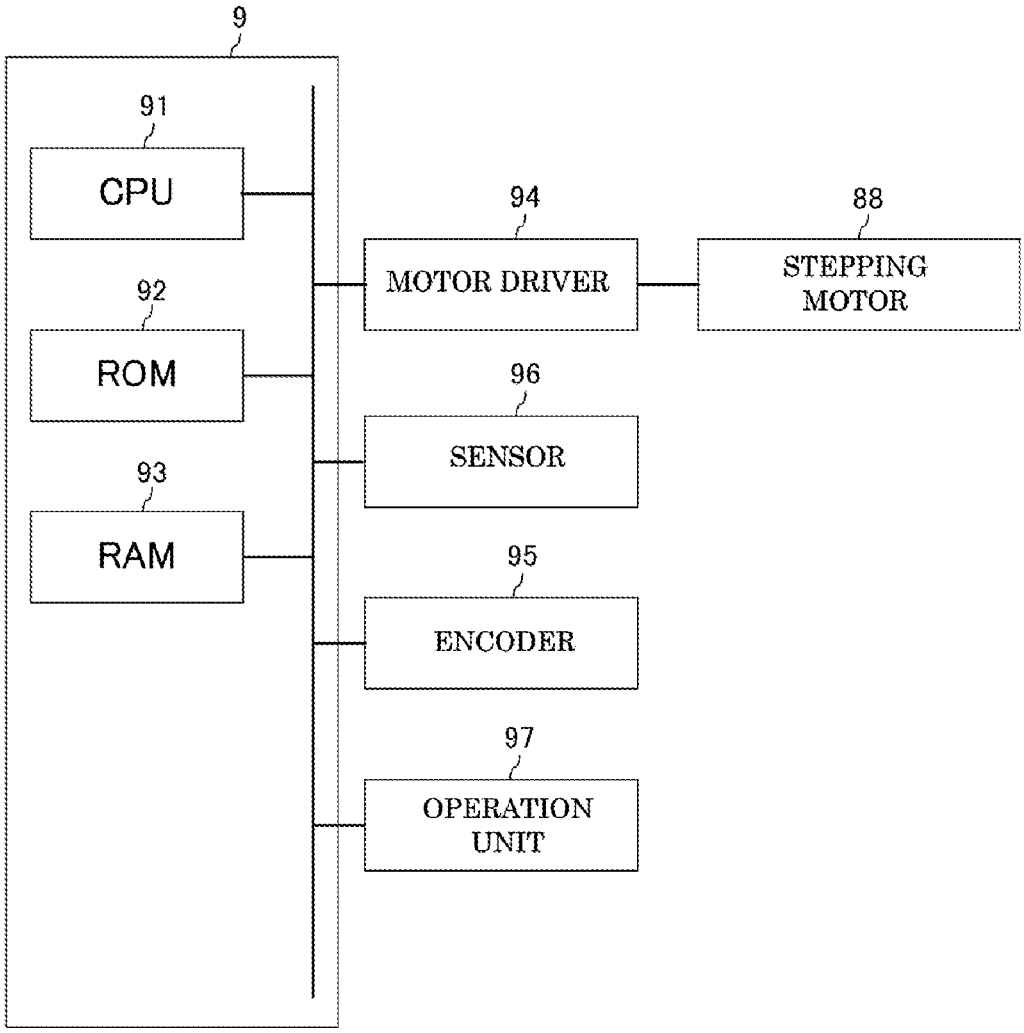
FIG. 12 is a block diagram illustrating a functional structure of a computer in a sewing machine.

FIG. 12 is a block diagram illustrating a functional structure of a computer 9 in the sewing machine 1. The sewing machine 1 has the computer 9 that includes a CPU 91, a ROM 92, a RAM 93, and a motor driver 94 for the stepping motor 88 which is the drive source of the bobbin-thread supply member 8. Input to this computer 9 are a value of an encoder 95 for the sewing-machine motor 6, detection results by various sensors 96, and operation results through an operation unit 97, such as various buttons and knobs.

The computer 9 detects the way of sewing based on the detection results by the various sensors 96 and the operation results, and controls a combination of the up-and-down timing of the bobbin-thread supply member 8, the up-and-down speed, and the pull-down amount in accordance with the detected way of sewing. In other words, the drive timing, rotation speed, and rotation angle of the stepping motor 88 that is the drive source for the bobbin-thread supply member 8 are controlled.

(Effects)

As explained above, according to this sewing machine 1, relative to the thread take-up lever 7, the needle bar 4, and the shuttle 5 which are actuated in conjunction with the sewing-machine motor 6 and which are linked with the transmission mechanism that includes the upper shaft 61 and the lower shaft 63, the bobbin-thread supply member 8 which receives drive power from the stepping motor 88 that is a different motor from the sewing-machine motor 6 is provided.

This bobbin-thread supply member 8 is driven by the drive power from the stepping motor 88, and applies tension to the bobbin thread 300 in accordance with the drive timing of the stepping motor 88 and the drive amount thereof.

Hence, the drive timing of the bobbin-thread supply member 8 and the drive amount thereof can be set flexibly, and thus the supply amount of the bobbin thread 300 and the supply timing thereof become controllable in accordance with various sewing conditions. In addition, since the drive timing of the bobbin-thread supply member 8 and the drive amount thereof can be set flexibly, it becomes possible for the sewing machine 1 to draw down the bobbin thread 300 from the stitch side at a predetermined timing. This enables the sewing machine 1 to form a high-quality stitch in accordance with various sewing conditions.

The bobbin-thread supply member 8 is in the form of a lever that pushes down the bobbin thread 300, and is pulled up and down by the drive power from the stepping motor 88. When, however, predetermined tension can be applied to the bobbin thread 300 at a predetermined timing, the present invention is not limited to this structure. For example, a roller that guides the bobbin thread 300 may be provided, and the position of this roller may be changed. In addition, a bar in a shuttle shape may be engaged with the roller to pull down the roller.

As to the transmission mechanism for the bobbin-thread supply member 8, the shaft 83 linked with the bobbin-thread supply member 8, and the cam pulley 86 that restricts the position of the shaft 83 are provided. The stepping motor 88 rotates the cam pulley 86 by a predetermined amount and at a predetermined timing. The shaft 83 changes the position in accordance with a change in restriction by the cam pulley 86 that is caused by the stepping motor 88, and pulls up or pulls down the bobbin-thread supply member 8 linked with the shaft 83. However, the present invention is not limited to this structure as long as the bobbin-thread supply member 8 can be displaced, and when it is desirable to set only the supply timing of the bobbin thread 300 to be variable, for example, a binary action of a voice coil motor may be transmitted.

As to the way of controlling the bobbin-thread supply member 8, the computer 9 that detects the sewing condition may actuate the bobbin-thread supply member 8 in accordance with a predetermined sewing condition, and may temporarily apply tension to the bobbin thread 300 before the thread take-up lever 7 reaches the top dead center, thereby increasing the supply amount of the bobbin thread 300. An example predetermined sewing condition in this case is zigzag stitches. This enables the sewing machine 1 to suppress a cloth shrinkage.

In addition, the bobbin-thread supply member 8 may be actuated in accordance with a predetermined sewing condition, and the bobbin thread 300 may be drawn down at a timing at which the thread take-up lever 7 reaches the top dead center. An example predetermined sewing condition in this case is straight stitches. This enables the sewing machine 1 to form a firm stitch.

(Other Embodiments)

Although the embodiment of the present invention was explained above, various omissions, replacements, and modifications can be made without departing from the scope of the present invention. Embodiments covering such omissions, etc., and the modified forms of such embodiments are within the scope and spirit of the present invention, and are also within the scope of the claimed invention and the equivalent range thereto.

What is claimed is:

1. A sewing machine forming a stitch by intertwining a needle thread and a bobbin thread with each other, the sewing machine comprising:

a first motor;

an upper shaft rotated by the first motor;

a lower shaft linked with the upper shaft, and rotated in conjunction with the upper shaft;

a thread take-up lever receiving drive power from the first motor through the upper shaft;

a needle bar receiving drive power from the first motor through the upper shaft;

a shuttle receiving drive power from the first motor through the lower shaft;

a second motor different from the first motor;

a bobbin-thread supply member driven by drive power from the second motor, applying and easing tension to the bobbin thread in accordance with a drive timing of the second motor and a drive amount of the second motor; and a controller detecting a sewing condition based on input information, and independently controlling the bobbin-thread supply member from the thread take-up lever in accordance with the detected sewing condition, wherein the bobbin-thread supply member temporarily applies, in accordance with a predetermined sewing condition, the tension to the bobbin thread before the thread take-up lever reaches a top dead center, and increases a supply amount of the bobbin thread.

2. The sewing machine according to claim 1, wherein the bobbin-thread supply member supplies the bobbin thread by applying the tension to the bobbin thread and by easing the tension.

3. The sewing machine according to claim 1, wherein the bobbin thread supply member comprises a lever that pushes down the bobbin thread, and is pulled up and down by the drive power from the second motor.

4. The sewing machine according to claim 3, further comprising:

a shaft linked with the bobbin-thread supply member; and a cam pulley restricting a position of the shaft, wherein:

the second motor rotates the cam pulley at a predetermined timing and by a predetermined amount; and the shaft changes the position in accordance with a change in restriction by the cam pulley, the change in restriction being caused by the second motor, and pulls up or down the linked bobbin-thread supply member.

5. The sewing machine according to claim 1, wherein the predetermined sewing condition is zigzag stitches.

6. A sewing machine forming a stitch by intertwining a needle thread and a bobbin thread with each other, the sewing machine comprising:

a first motor;

an upper shaft rotated by the first motor;

a lower shaft linked with the upper shaft, and rotated in conjunction with the upper shaft;

a thread take-up lever receiving drive power from the first motor through the upper shaft;

a needle bar receiving drive power from the first motor through the upper shaft;

a shuttle receiving drive power from the first motor through the lower shaft;

a second motor different from the first motor;

a bobbin-thread supply member driven by drive power from the second motor, applying and easing tension to the bobbin thread in accordance with a drive timing of the second motor and a drive amount of the second motor; and a controller detecting a sewing condition based on input information, and independently controlling the bobbin-thread supply member from the thread take-up lever in accordance with the detected sewing condition, wherein the bobbin-thread supply member draws down, in accordance with a predetermined sewing condition, the bobbin thread at a timing when the thread take-up lever reaches a top dead center.

7. The sewing machine according to claim 6, wherein the predetermined sewing condition is straight stitches.

8. The sewing machine according to claim 6, wherein the bobbin-thread supply member supplies the bobbin thread by applying the tension to the bobbin thread and by easing the tension.

9. The sewing machine according to claim 6, wherein the bobbin thread supply member comprises a lever that pushes down the bobbin thread, and is pulled up and down by the drive power from the second motor.

10. The sewing machine according to claim 9, further comprising:

a shaft linked with the bobbin-thread supply member; and a cam pulley restricting a position of the shaft, wherein:

the second motor rotates the cam pulley at a predetermined timing and by a predetermined amount; and the shaft changes the position in accordance with a change in restriction by the cam pulley, the change in restriction being caused by the second motor, and pulls up or down the linked bobbin-thread supply member.

* * * * *